US006203051B1

(12) United States Patent
Sabol

(10) Patent No.: US 6,203,051 B1
(45) Date of Patent: Mar. 20, 2001

(54) SAFETY ROTATABLE SNOWBOARD BOOT BINDING

(75) Inventor: Jeffrey P. Sabol, 235 Osborne AV, Waterville, NY (US) 13480

(73) Assignee: Jeffrey P. Sabol, Waterville, NY (US)

( * ) Notice: Subject to any disclaimer, the term of this patent is extended or adjusted under 35 U.S.C. 154(b) by 0 days.

(21) Appl. No.: 09/565,859

(22) Filed: May 6, 2000

Related U.S. Application Data

(63) Continuation-in-part of application No. 09/274,806, filed on Mar. 23, 1999, now Pat. No. 6,062,584.

(51) Int. Cl.[7] ..... A63C 9/00

(52) U.S. Cl. ..... 280/607; 280/618; 280/14.24; 403/103; 403/116; 411/354

(58) Field of Search ..... 403/116, 103, 403/104; 411/354; 269/57, 67, 69, 82; 280/607, 617, 618, 633, 634, 14.21, 14.22, 14.24

(56) References Cited

U.S. PATENT DOCUMENTS

| | | | | |
|---|---|---|---|---|
| 4,728,116 | * | 3/1988 | Hill | 280/618 |
| 4,871,337 | * | 10/1989 | Harris | 280/14.2 X |
| 4,964,649 | * | 10/1990 | Chamberlin | 280/618 |
| 5,028,068 | * | 7/1991 | Donovan | 280/618 |
| 5,240,265 | * | 8/1993 | Huang | 403/116 X |
| 5,261,689 | * | 11/1993 | Carpenter et al. | 280/618 |
| 5,354,088 | * | 10/1994 | Vetter et al. | 280/618 |
| 5,499,837 | * | 3/1996 | Hale et al. | 280/607 |
| 5,553,883 | * | 9/1996 | Erb | 280/607 |
| 5,577,755 | * | 11/1996 | Metzger et al. | 280/14.2 X |
| 5,584,492 | * | 12/1996 | Fardie | 280/14.2 |
| 5,586,779 | * | 12/1996 | Dawes et al. | 280/14.1 |
| 5,667,237 | * | 9/1997 | Lauer | 280/607 |
| 5,791,678 | * | 8/1998 | Perlman | 280/14.2 X |
| 5,803,481 | * | 9/1998 | Eaton et al. | 280/14.2 X |
| 5,810,370 | * | 9/1998 | Covert et al. | 280/618 X |
| 5,897,128 | * | 4/1999 | McKenzie et al. | 280/607 |

* cited by examiner

*Primary Examiner*—Michael Mar
(74) *Attorney, Agent, or Firm*—Donald W. Meeker

(57) ABSTRACT

A base plate is secured to any existing snowboard with screws or bolts through holes in the base plate mating with the standard holes in the snowboard. A rotatable plate has a wide groove to receive a standard existing boot binding and the two have circular openings which fit rotatably over a protruding circular guide post on the base plate. A cap plate with mating holes and a protruding bottom circular plate extends through the boot binding and rotatable plate openings to contact the guide post on the base plate with the screws or bolts passing through all the mating holes to the snowboard. An elevated rim around the cap plate fits within a circular groove of the boot binding to allow the boot binding and rotatable plate to rotate relative to the cap plate. A low-friction ring has bottom teeth to fit within the teeth of the boot binding and a top low-friction top surface to contact the cap plate. A two-position locking shaft may be locked with the locking shaft inserted in any of the lock holes in a lock ring around the perimeter of the base plate to secure the boot binding at a desired angle to the snowboard and alternately locked with the locking shaft out of the lock holes so that the binding rotates freely. A spring may bias the locking shaft in the locked position. Alternately a spring biased shaft may be lifted out of the locked position and released to return to the locked position by the force of the spring. The lock ring is elevated above the snowboard to allow the lock holes to drain to prevent icing of the lock holes. A protruding pin from the rotatable plate fits within an arc of a circular groove in the base plate to limit the degree of rotation of the snowboard boot for safety. Springs between the pin and the circular groove may control the rotation therebetween.

19 Claims, 6 Drawing Sheets

SAFETY ROTATABLE SNOWBOARD BOOT BINDING

REFERENCES TO RELATED APPLICATIONS

This is a continuation-in-part of U.S. patent application Ser. No. 09/274,806 filed Mar. 23, 1999 now U.S. Pat. No. 6,062,584.

BACKGROUND OF THE INVENTION

1. Field of the Invention

The present invention relates to bindings for snowboards, and in particular to a rotatable binding which is configured to retrofit a standard snowboard boot binding and may be both locked in a stationary position and locked in a free rotation condition and which has an elevated lock ring to prevent icing of the locking holes, spring-controlled rotation with a safety stop, and spring-loaded variations of the locking mechanism.

2. Description of the Prior Art

Snowboard boot bindings are normally screwed onto the snowboard in a permanent orientation which is almost perpendicular to the direction of travel of the snowboard. This orientation is good for riding downhill on the snowboard, but is very uncomfortable when traveling over a flat or uphill snow contour, when it is necessary to release the back boot and use that boot to propel the snowboard. Having the front boot nearly perpendicular to the snowboard with the snowboard and back foot moving straight forward is very uncomfortable and potentially dangerous because a fall in this orientation may injure the ankle or knee joints of the snowboarder. Furthermore on a chair lift having the foot nearly perpendicular to the snowboard causes the snowboard to be positioned across the front of the chair which is an awkward orientation for mounting and dismounting and is disturbing or damaging to anyone seated on an adjacent chair. Mounting and dismounting the chair lift poses a serious danger for potential injury with the foot oriented nearly perpendicular to the snowboard.

It is desirable to be able to change the orientation of the snowboard boot binding when traveling on flats and uphills and when mounting and dismounting a chair lift to orient the front boot parallel to the snowboard for ease in propelling the snowboard forward with the rear boot, which is released from the binding.

It is also desirable to be able to adjust the angle of the snowboard boot binding to any desired orientation to the snowboard to adapt to individual preferences for best downhill snowboarding performance and to accommodate different snow and terrain conditions. For example, a nearly perpendicular orientation of the boots may be better for broad sweeping turns down a wide slope, while a slightly more forward orientation of the boots may be more desirable for moguls or snowboarding down narrow trails where tight fast turns are required.

In addition, a snowboarder may prefer to be able to adjust the rear boot at a different orientation from the front boot, particularly for stunt snowboarding.

A number of prior art devices have provided rotatable snowboard bindings, but lack the improved performance and ease of adjustability of the present invention.

U.S. Pat. No. 5,577,755, issued Nov. 26, 1996 to Metzger et al., provides a rotatable binding for a snowboard with a base plate on the snowboard and a binding plate and foot binding rotatably mounted on top of the base plate with a locking assembly for selectively locking the binding plate to the base plate at any desired angle. The top of the base plate has an indexing platform with a circular series of bores to receive a spring-loaded pin (or two pins) with a large loop for locking the binding plate in position. Indexing markers on the base plate align the pin or pins with the holes of the base plate. The Metzger patent does not have roller bearings, a screw-type lock which can be securely fixed in the up or down position, an elevated lock ring to prevent icing, a central guide post for ease of alignment during assembly, an easy grasp elevated T-shaped lock handle for use with gloves or mittens, a positive engagement safety device to limit the degree of rotatability during free rotation, a spring rotation control, or a retrofit capability for using the existing boot binding and snowboard.

U.S. Pat. No. 4,964,649, issued Oct. 23, 1990 to Chamberlin, shows a snowboard boot binder which allows the rider to rotate his boots while riding the snowboard. It has two base plates secured to the board and two plates with boot binders rotatably connected to the base plates. Springs between each rotating plate and each base plate limit relative motion therebetween and bias the rotating plates to return to the original angle of orientation after the rider rotates the plates. The Chamberlain patent does use ball bearings. It does not have a secure screw-type up and down locking device, does not have an elevated lock ring to prevent icing, a central guide post for ease of alignment during assembly, an easy grasp elevated T-shaped lock handle for use with gloves or mittens, a positive engagement safety device to limit the degree of rotatability during free rotation, and does not have retrofit capability.

U.S. Pat. No. 5,586,779, issued Dec. 24, 1996 to Dawes et al., claims an adjustable snowboard boot binding apparatus which is rotatably adjustable "on the fly" without removing the boot from the binding and is compatible with existing snowboard boot bindings. A central hub is attached to the board and a top binding mounting plate and bottom circular rotating plate are interconnected and sandwich the hub between them, so that the binding plate and circular plate rotate on a bearing between the binding plate and the central hub. No snow or ice may penetrate to the hub. A spring-loaded plunger lock mechanism locks the binding plate to the central hub in a series of holes in the hub. Alternately, gear teeth on the hub may interact with a plunger to lock the device. Several other locking devices are shown. The Dawes patent does not have a secure screw-type up and down locking device. The Dawes patent does have a retrofit capability, but does not provide a low-friction ring between the binding and the cap plate to allow the cap plate to be bolted tight to the snowboard and bottom baseplate to secure the entire assembly with only four bolts with the binding and rotatable plate sandwiched rotatably between the cap plate and baseplate, and instead the Dawes patent requires a number of screws or bolts securing various layers of plates together for relative rotation therebetween. The Dawes patent does not provide an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,028,068, issued Jul. 2, 1991 to Donovan, describes a quick-action adjustable snowboard boot binding comprising a support plate to which a conventional boot binding is mounted. The support plate is fixedly attached to a circular swivel plate which rotates, via a center bearing, relative to a base plate attached to the board. A cable encircles a groove in the swivel plate and a handle pivots up to release the cable for adjusting the angle of the swivel plate and pivots down to tighten the swivel plate at a desired angle. Both boot bindings are angularly adjustable. The Donovan patent does not have a secure screw-type up and down locking device and does not have retrofit capability to fit any existing binding, and does not have an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,261,689, issued Nov. 16, 1993 to Carpenter et al., discloses a snowboard binding system utilizing a binding plate supported on the snowboard with a circular disk-shaped hold-down plate over the binding plate. The binding plate rotates relative to the hold-down plate, which each have ribs or ridges which interact to lock the rotational position of the binding plate. The boot must be removed and attaching screws loosened to change the angular orientation. Both bindings are rotatable. The Carpenter patent does not have a secure screw-type up and down locking device and does not have retrofit capability. Further, Carpenter lacks a wide track roller bearing, an elevated lock ring to prevent icing, a central guide post for ease of alignment during assembly, a positive engagement safety device to limit the degree of rotatability during free rotation, a spring rotation control, and an easy grasp elevated T-shaped lock handle for use with gloves or mittens.

U.S. Pat. No. 5,553,883, issued Sep. 10, 1996 to Erb, indicates a snowboard binding which permits angular reorientation of a user's foot while maintaining that foot attached to the snowboard and utilizes a footplate that is rotatably connected in close proximity to the snowboard by a circular anchor plate. A pair of spring biased pins inserted in a circular array of holes in the snowboard lock the footplate at any desired angle. Both bindings are rotatable. The Erb patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,354,088, issued Oct. 11, 1994 to Vetter et al., puts forth a coupling for releasably mounting a boot with boot binding to a turntable ring which is adjustably secured to a snowboard. A spring loaded pin with a long cord is the locking mechanism. The Vetter patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,667,237, issued Sep. 16, 1997 to Lauer, concerns a rotary locking feature for a snowboard binding allowing rotation of a snowboard binding relative to the snowboard without removal of the binding from the boot. It utilizes a releasable latch integral with the binding to disengage a rotatable locking mechanism having a stationary circular hub notched around the perimeter with a spring-loaded pointer engaging the notches to lock the rotating binding in place at a desired angle. The Lauer patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,499,837, issued Mar. 19, 1996 to Hale et al., illustrates a swivelable mount for a snowboard having a rotatable binding plate attached to a circular plate which rotates in a circular groove of a base plate secured to the snowboard. A handle with a cam and spring-loaded pin secures the binding plate at a desired angle. The Hale patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 4,728,116, issued Mar. 1, 1988 to Hill, is for a releasable binding for snowboards having a ring secured to a snowboard and a block rotatably mounted on the ring with boot-engaging plugs at each end of the block. A spring-loaded double pin locking system is operated by a handle to move both pins simultaneously for locking the binding at a desired angle. The Hill patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 4,871,337, issued Oct. 3, 1989 to Harris, provides a binding for a snowboard (and water ski board) with longitudinal and angular adjustment. Riding plates move along a channel running down the center of the board traveling on a pivotable connector riding in the channel locked in place by a thumbscrew. The Harris patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

U.S. Pat. No. 5,584,492, issued Dec. 17, 1996 to Fardie, provides an adjustable snowboard binding assembly which can be rotatably controlled without the use of external tools. The snowboard mounting platforms each have a plurality of inwardly facing radial teeth along the circumference of a centralized circular cutout, the bottom of which rests on four quadrant segments connected to a stainless steel band which moves along a groove in the center of the board activated by a lever. The mounting platform can rotate relative to the four quadrant segments and is locked in place at a desired angle by two spring loaded sliding segments with mating teeth to engage the teeth on the mounting platform to lock it in place at a desired angle. The Fardie patent does not have a secure screw-type up and down locking device, a retrofit capability, a large diameter roller bearing, an elevated lock ring to prevent icing, a central guide post for ease of alignment during assembly, a positive engagement safety device to limit the degree of rotatability during free rotation, a spring rotation control, or an easy grasp elevated T-shaped lock handle for use with gloves or mittens.

None of the prior art enable a secure locking of the snowboard boot binding in either the hold down position or the freely rotating position. They require holding the locking mechanism to allow rotation and releasing the locking mechanism to lock it by spring action or friction. They further lack a central guide post for ease of alignment during assembly combined with a retrofit capability, an easy grasp elevated T-shaped lock handle for use with gloves or mittens, large diameter roller bearings for ease of rotation, a positive engagement safety device to limit the degree of rotatability during free rotation, and an elevated lock ring to prevent icing of the locking holes. The prior art patents do not provide a low-friction ring with bottom teeth engaging the teeth of the existing boot binding to preserve the teeth of the existing boot binding and a top low-friction surface of the low-friction ring contacting the cap plate to permit rotation of the boot binding beneath the cap plate.

None of the prior art devices provide an advertising or identification plate combined with the snowboard binding.

SUMMARY OF THE INVENTION

A primary object of the present invention is to provide a retrofit device adapted to existing snowboards and existing snowboard boot bindings which retrofit device converts the existing snowboard boot binding into a rotatable snowboard boot binding which has a slip sleeve binding tab screw-type locking mechanism having a square locking shaft which fits within an externally threaded sleeve having binding tabs which are forced against the square locking shaft by tapering side walls upon screwing down the lock handle to enable a secure screw locking of the mechanism in either an up or down position. Locking the mechanism in the up position allows hands-free rotation of the snowboard boot binding while standing upright or with bended knees in the downhill position to insure the exact angle of orientation of the boot binding with the snowboard. Locking the mechanism in a down position engaging the locking ring hole with the screw locking mechanism with the snowboard boot binding in any desired angular orientation to the snowboard insures that the boot will not slip out of the desired position for downhill boarding with both feet angled, or for level and uphill propelling with one foot aligned with the snowboard and the other free. On the ski lift one boot is locked securely at a comfortable and safe straight alignment with the snowboard for ease and safety of mounting and dismounting and trouble-free straight orientation while riding the lift.

A related object of the present invention is to provide a spring loaded locking mechanism for ease of insertion with the spring biasing the mechanism in the locked orientation for ease of insertion. The spring loaded locking mechanism may be employed in the double locking mechanism or a conventional lock down only mechanism.

A secondary object of the present invention is to provide an elevated locking ring which elevates the locking holes into which the locking shaft is inserted higher than the level of the snowboard so that water and slush will not collect in the locking holes and freeze, which would prevent the insertion of the locking shaft in the locking holes.

A third object of the present invention is to provide an elevated T-handle on the locking shaft, which handle protrudes vertically for ease of grasping and operation with a gloved or mittened hand.

Another object of the present invention is to provide a large diameter roller bearing or pair of large diameter roller bearings for a free and easy rotation of the boot binding regardless of the weight of the snowboarder. The large diameter roller bearing further enables the use of large bearings which are less likely to become immobile from icing.

One more object of the present invention is to provide a retrofit device to convert an existing snowboard boot binding into a rotatable snowboard boot binding, which retrofit device has the screw hole configurations to adapt to the commonly used snowboard boot bindings so that the existing bindings are merely unscrewed, the device of the present invention is placed under the existing binding and four bolts secure the cap plate, existing binding, and the device of the present invention to the snowboard. A low-friction ring with bottom teeth fits into the teeth of the existing boot binding to preserve the teeth of the existing boot binding, while a low-friction top surface of the low-friction ring contacts the cap plate to allow rotation of the boot binding and rotatable plate of the invention relative to the cap plate.

An additional object of the present invention is to provide an elevated large diameter guide post in the center of the base plate for ease of aligning and mounting the rotatable plate thereon.

A further object of the present invention is to provide a rotatable plate with a wide rectangular groove for receiving all standard snowboard boot bindings therein for a universal retrofit capability.

Yet another object of the present invention is to provide a positive engagement safety device in the form of a pin on one plate and a mating arc of a circular groove on the adjacent plate, one of which plates is rotatable relative to the other, to limit the degree of rotatability during free rotation to a safe arc of about 100 degrees, thereby preventing injuries which might occur if the foot were capable of rotating further.

A corollary object of the present invention is to provide one or more springs attachable between the two plates to control rotation.

An added object of the present invention is to provide an elevated flat labeling surface on the rotatable plate for advertising information, such as a name and phone number of the seller of the snowboard, or for engraving the name of the owner or any other desired information thereon.

In brief, a base plate with an elevated central guide post and hole configuration to mate with standard snowboard holes is secured to the snowboard. A rotatable plate has a circular opening slightly larger than the guide post and fits rotatably over the guide post. The rotatable plate has a wide top groove to receive any standard snowboard boot binding. A cap having similar mating holes and bolts or screws is screwed through the base place holes into the mating holes in the snowboard. The cap has an elevated outer rim which fits rotatably in a recessed groove in the boot binding and a recessed circular bottom which fits through a circular opening in the boot binding and mating circular opening in the rotatable plate to contact the guide post of the base plate. The rotatable plate and boot binding are rotatably sandwiched between the cap and the base plate.

A low-friction ring with bottom teeth and top low-friction surface is set into the teeth of the existing boot binding with the low-friction top surface contacting the cap plate, or a large roller bearing ring may be installed between the cap plate and the low friction plate. Another large roller bearing ring may be installed between the rotatable plate and the base plate to facilitate the ease of rotation of the integrated rotatable plate and boot binding.

A screw-type locking mechanism on the rotatable plate has an upwardly protruding T-shaped handle which is easy to grasp and operate with mittens or gloves. A square cross-section lock shaft fits slidably within a sleeve with exterior threads and four binding tabs. When the sleeve is screwed tight into a lock base on the rotatable plate, sloping walls of the lock base press the four binding tabs against the sides of the lock shaft to bind the lock shaft in place. When the sleeve is partially unscrewed, the binding tabs recede from the sloping walls and the lock shaft is free to slide up and down. The lock shaft may be locked in a down position with the end of the shaft through any of a series of holes in a lock ring around the perimeter of the base plate to lock the rotatable plate and boot binding securely in any desired horizontal angular orientation to the snowboard. Alternately, the lock shaft may be securely locked in an up position with the end of the lock shaft above the base plate, so that the rotatable plate and boot binding rotates freely without holding the lock mechanism, enabling the snowboarder to stand in any position to adjust the boot binding at any desired angle. The lock shaft may be spring biased to assist in inserting the shaft into one of the holes in the lock ring. Alternately, a shaft without a locking mechanism may have a spring biasing the shaft in the lock position, so that upon lifting the shaft out of the lock position rotating the rotatable plate to a desired position, and releasing the shaft, it will automatically be biased into the hole in the lock shaft by the spring.

The lock ring of the base plate is elevated above the snowboard to enable water, slush, and snow to drain out of the lock holes by gravity to prevent icing in the holes, so that the lock shaft will always fit easily into the lock holes.

A positive engagement safety device comprises a pin on either the rotatable plate or the base plate engaging a mating arc of a circular groove on the other plate, with the pin stopped at each end of the arc to limit the degree of rotatability during free rotation to a safe arc of about 100 degrees, thereby preventing injuries which might occur if the foot were capable of rotating further. A pair of springs positioned in the groove with one on each side of the pin control the rotation rate of the rotatable plate and cause the rotatable plate to return to its original position upon release of the rotatable plate.

An advantage of the present invention is that a snowboard boot binding is easily rotatable by the snowboarder in any position, standing or kneeling or whatever, without the need for the snowboarder to hold onto the lock mechanism while rotating the boot binding. This enables the snowboarder to adjust the angle of the binding to the exact angular orientation desired for different positions of performance and different snow conditions. It enables the snowboarder to make the adjustments while on the slope or the flat or on the lift.

Another advantage of the present invention is that the lock holes will not ice up, so that the lock mechanism always operates easily and smoothly with the lock shaft sliding easily into the lock holes.

Still another advantage of the present invention is that the large upwardly protruding T-shaped handle is easily gripped and operated by the snowboard with mittens or gloves on.

A corollary advantage of the present invention is that the screw-type lock locks securely without danger of the lock shaft being knocked out of the lock holes by rough operation of the snowboard and the large T-shaped handle provides the leverage to enable the snowboarder to screw the lock mechanism down tightly.

An additional advantage of the present invention is that it may be retrofit to any existing snowboard and utilize the existing boot binding on the snowboard, so that only the rotatable plate, base plate, cap plate, low-friction ring, and optional bearings need be acquired to convert an existing snowboard with stationary boot bindings into a snowboard with one or two rotatable adjustable boot bindings.

A related advantage of the present invention is that the low-friction ring preserves the teeth of the existing boot binding while providing a low-friction surface to contact the cap plate or the optional roller bearing between the cap plate and the low-friction ring, allowing free rotation of the boot binding.

One more advantage of the present invention is that it is easily and accurately installed with mating holes aligning the base plate with the snowboard, a guide post aligning the rotatable plate and cap with the base plate, and a wide groove aligning the existing boot binding with the rotatable plate, requiring only four bolts to secure each converted boot binding to the snowboard.

Yet another advantage of the present invention is that using large diameter roller bearing rings allows very easy rotation of the boot binding.

Still another advantage of the present invention is that having a positive engagement safety limit of rotation of the boot permits free rotation of the boot without danger of rotating too far to create an injury.

A further advantage of the present invention is that it provides an elevated advertising or name plate surface clearly visible on the rotatable plate on the other side of the boot binding groove opposite to the lock mechanism.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
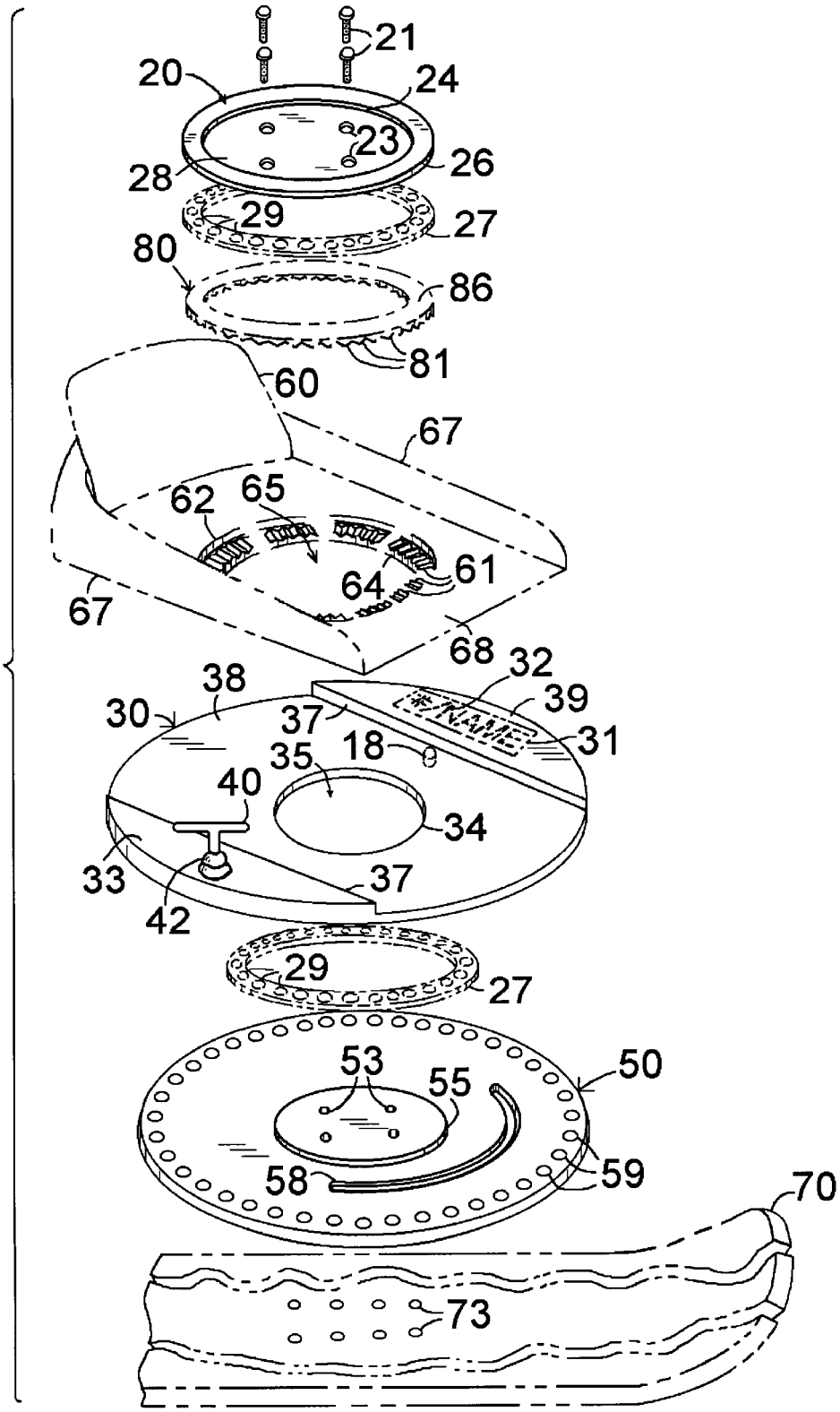
FIG. 1 is an exploded perspective view showing the components of the invention aligned for assembly with the existing snowboard and existing snowboard boot binding.
Figure 2:
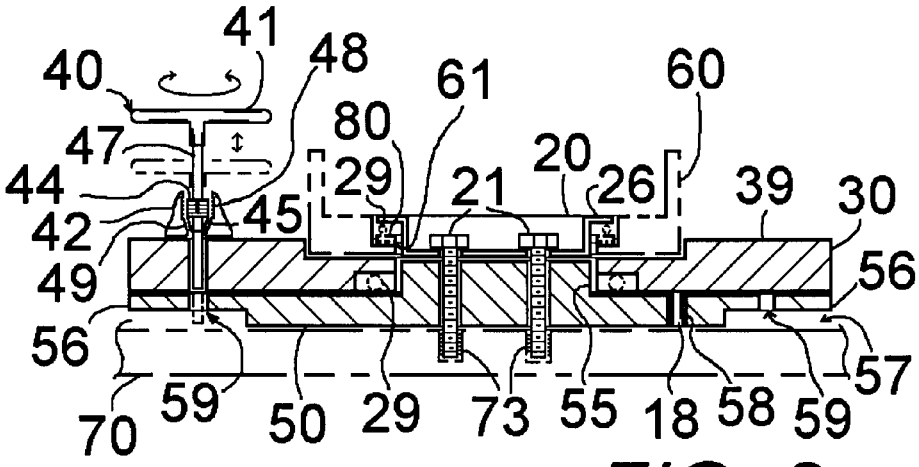
FIG. 2 is a cross-sectional view taken through the centerline of the assembled invention having both an upper roller bearing between the binding attaching plate and the boot binding and a lower roller bearing between the rotatable plate and the base plate.

In FIGS. 1, 2 and 6–8 the invention comprises a rotatable snowboard boot binding device having a pair of rigid plates which may be retrofit to a standard snowboard 70 (shown dashed) and a standard snowboard boot binding 60 (shown dashed). A base plate 50 is adapted to be secured to the snowboard 70 with mating holes 53 in the bottom base plate to match the standard holes 73 in the snowboard 70 secured together by screws or bolts 21 screwed into the snowboard holes 73. A top rotatable plate 30 is adapted for receiving a standard snowboard binding 60 in a wide recessed groove area 38 having side walls 37, the top rotatable plate secured to the bottom base plate by a rotatable means such as a circular opening 35 in the rotatable plate 30 fit over the slightly smaller diameter circular elevated guide post 55 of the bottom base plate 50 allowing rotation therebetween. A large diameter bottom roller bearing ring 27 with roller bearings 29 may fit between the plates to facilitate the rotation.

Bolts or screws 21 through mating holes 23 in a top cap plate 20 secure the existing boot binding 60 and the rotatable plate 30 to the base plate 50 and to the existing snowboard 70 so that the boot binding and rotatable plate are rotatable relative to the base plate 50 and the top cap plate 20. The downwardly protruding circular bottom 28 of the cap plate 20 is slightly smaller than the circular opening 65 formed by an inner circular wall 64 in the existing boot binding 60 and the outer elevated peripheral lip 26 of the cap plate 20 is slightly smaller in diameter than the outer circular wall 62 in the boot binding, so that the boot binding is free to rotate relative to the cap plate. The height of the circular wall 24 of the cap plate 20 is such that with the downwardly protruding circular bottom 28 of the cap plate 20 firmly secured to the protruding circular guide post 55 of the base plate 50, the outer elevated lip 26 of the cap plate 20 does not restrict the circular ridge with teeth 61 of the boot binding 60 so that the boot binding 60 and the rotatable plate 30 are free to rotate relative to the cap plate. A low-friction ring 80 (shown dashed) has bottom teeth 81 to engage the teeth 61 of the boot binding 60 and a top low-friction surface 86 to contact the outer elevated lip 26 of the cap plate 20 for easier rotation between the cap plate and the boot binding and to preserve the teeth 61 of the boot binding 60. A top large diameter roller bearing ring 27 with roller bearings 29 may be positioned between the cap plate 20 and the low-friction ring 80 to facilitate rotation therebetween.

The preferred embodiment of the rotatable snowboard boot binding device has a double screw locking mechanism 40 capable of locking in a down position (shown dashed in FIGS. 2 and 6–8) engaging both the base plate 50 and the rotatable plate 30 with the end of the locking shaft 47 through one of the lock holes 59 in the elevated lock ring 56 of the base plate 50, so that the rotatable plate 30 is secured to the base plate 50 to prevent rotation therebetween and the side walls 67 of the snowboard boot binding 60 secured within the parallel side walls 37 of the wide groove 38 of the rotatable plate 50 is stationary relative to the snowboard 70. The double screw locking mechanism 40 is further capable of locking in an up position (shown in solid lines) free of the base plate 50 to allow rotation between the rotatable plate 30 and the base plate 50 so that the snowboard boot binding 60 is rotatable relative to the snowboard 70 without holding the locking means 40.

The base plate has an elevated lock ring 56 with a series of openings 59 around the perimeter of the base plate 50. The locking shaft 47 from the rotatable plate 30 is capable of selectively engaging any one of the openings 59 of the base plate 50 to allow the rotatable plate and boot binding to be securely screw locked at any desired horizontal angle to the snowboard. The elevated lock ring 56 is elevated above the snowboard 70 with a space 57 therebetween (FIGS. 2 and 6–8) so that the lock holes 59 are elevated above the snowboard and fluids may drain from the lock holes to prevent icing in the lock holes 59.

Figure 3:
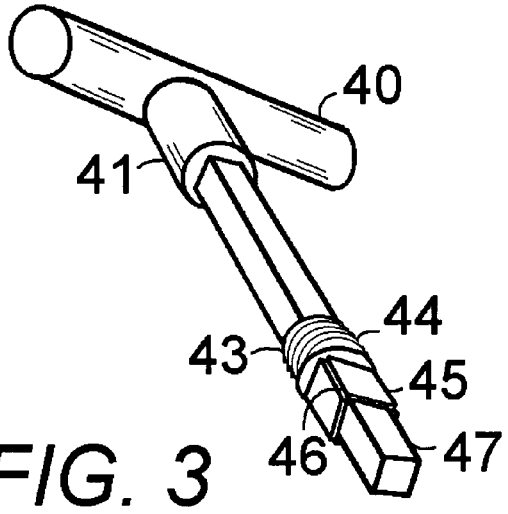
FIG. 3 is a perspective view showing the T-shaped lock handle, square lock shaft, and externally threaded sleeve with binding tabs fitting slidably over the lock shaft.
Figure 4:
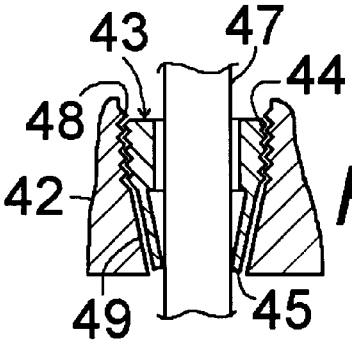
FIG. 4 is a cross-sectional view taken through the lock base showing the externally threaded sleeve screwed down tight with the tapered walls of the lock base forcing the binding tabs against the lock shaft to bind it in place.
Figure 5:
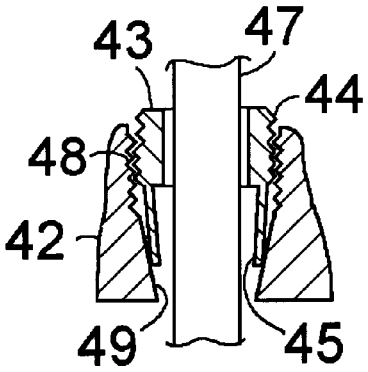
FIG. 5 is a cross-sectional view taken through the lock base showing the externally threaded sleeve screwed only part way into the lock base so that the binding tabs are apart from the lock shaft and the lock shaft is free to slide up and down in the externally threaded sleeve.
Figure 6:
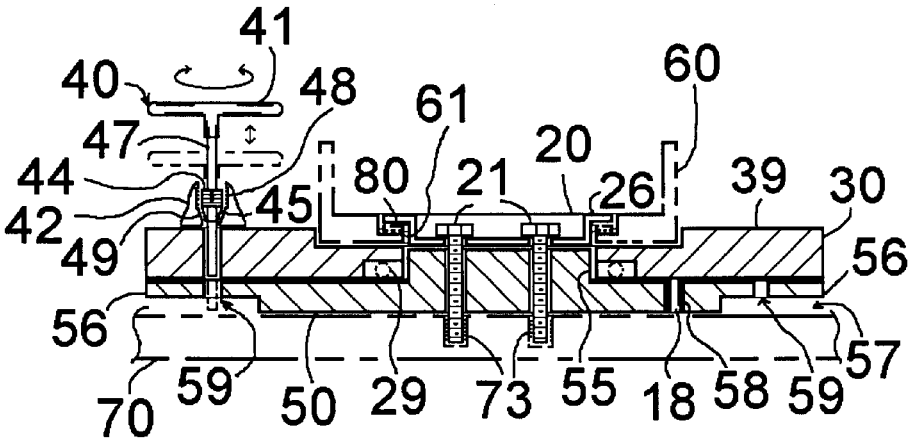
FIG. 6 is a cross-sectional view taken through the centerline of the assembled invention having only a lower roller bearing between the rotatable plate and the base plate and no upper roller bearing.
Figure 7:
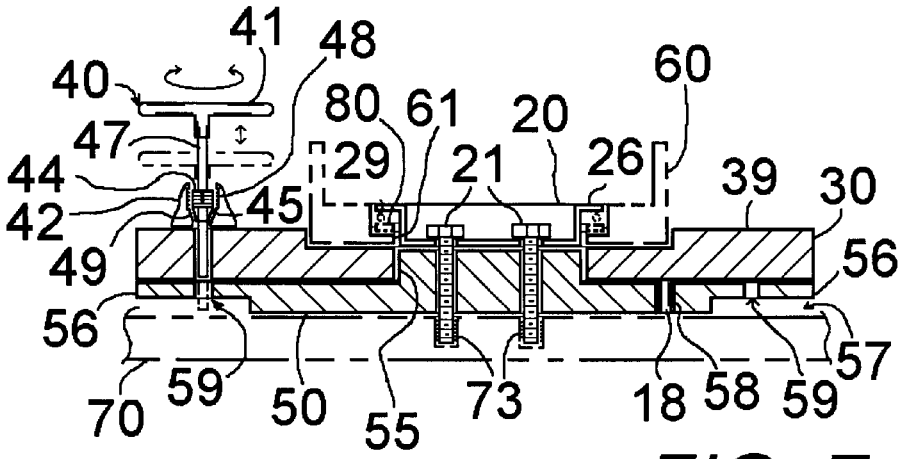
FIG. 7 is a cross-sectional view taken through the centerline of the assembled invention having only an upper roller bearing between the binding attaching plate and the boot binding and no lower roller bearing.
Figure 8:
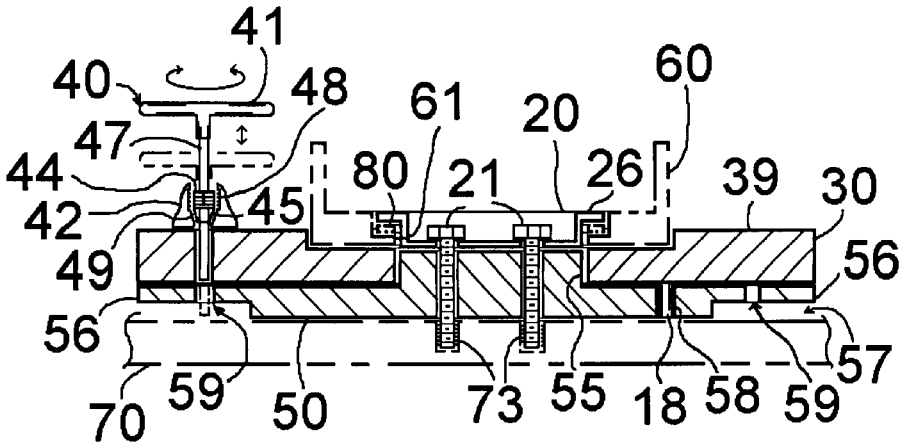
FIG. 8 is a cross-sectional view taken through the centerline of the assembled invention having no upper roller bearing and no lower roller bearing.

In FIGS. 3, 4, and 5 the double lock screw lock mechanism 40 comprises a square cross-sectioned locking shaft 47 which fits slidably within a sleeve 43 with external threads 44 and with four binding tabs 45 separated by slots 46, the binding tabs adjacent to the four sides of the locking shaft, so that the locking shaft 47 is capable of turning the externally threaded sleeve 43 to screw the externally threaded sleeve 43 into and out of a locking base 42 secured to the rotatable plate 30. The locking shaft 47 is provided at its top end with a T-shaped handle 41 protruding above the locking base 42 for easy grasping and good leverage in tightening and loosening the screw with gloved or mittened hands. The locking base 42 for receiving the locking shaft 47 therethrough is attached to the rotatable ring 30 on an elevated side 33 adjacent to the boot binding groove 38. The locking base 42 has a hollow vertical opening with internal threads 48 over a top portion and having downwardly and inwardly tapering walls 49 over a bottom portion, so that the externally threaded sleeve 43 is capable of engaging the internal threads 48 of the locking base 42. In a loosely screwed engagement, as in FIG. 5, the locking shaft 47 is freely movable vertically within the externally threaded sleeve 43. In a tightly screwed engagement of the externally threaded sleeve 43 with the internal threads 48 of the locking base 42, as in FIG. 4, the binding tabs 45 of the externally threaded sleeve are forced against the locking shaft 47 by the tapering walls 49 of the locking base 42 securely locking the locking shaft 47 within the locking base 42. With the locking shaft 47 screwed tight in the locked position and engaging one of the openings 59 (as in dashed lines in FIGS. 2 and 6–8) in the base plate 50 it prevents rotation of the rotatable plate 30 and the boot binding 60. With the locking shaft 47 not engaging one of the openings 59 in the base plate 50, (as in solid lines in FIGS. 2 and 6–8) it allows free rotation of the rotatable plate 30 and the boot binding 60 without holding the T-shaped handle 41 of the locking mechanism.

Figure 10:
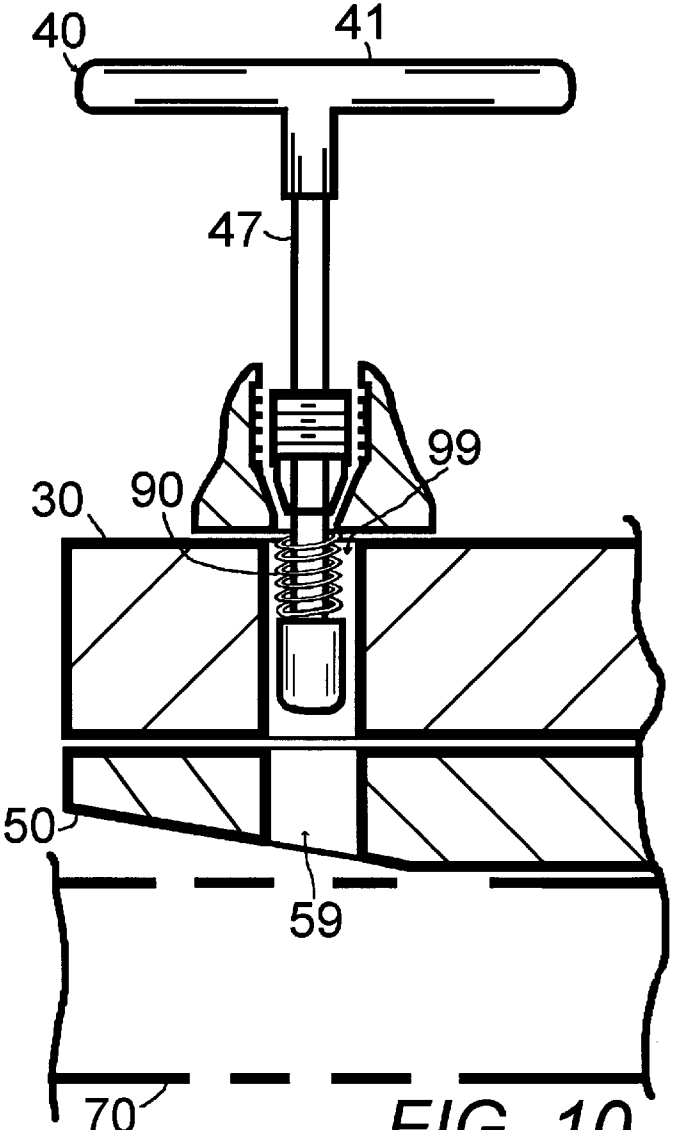
FIG. 10 is an enlarged partial cross-sectional view of the alternate embodiment of the locking mechanism of FIG. 9 with a spring on the double screw lock in the released mode position.
Figure 9:
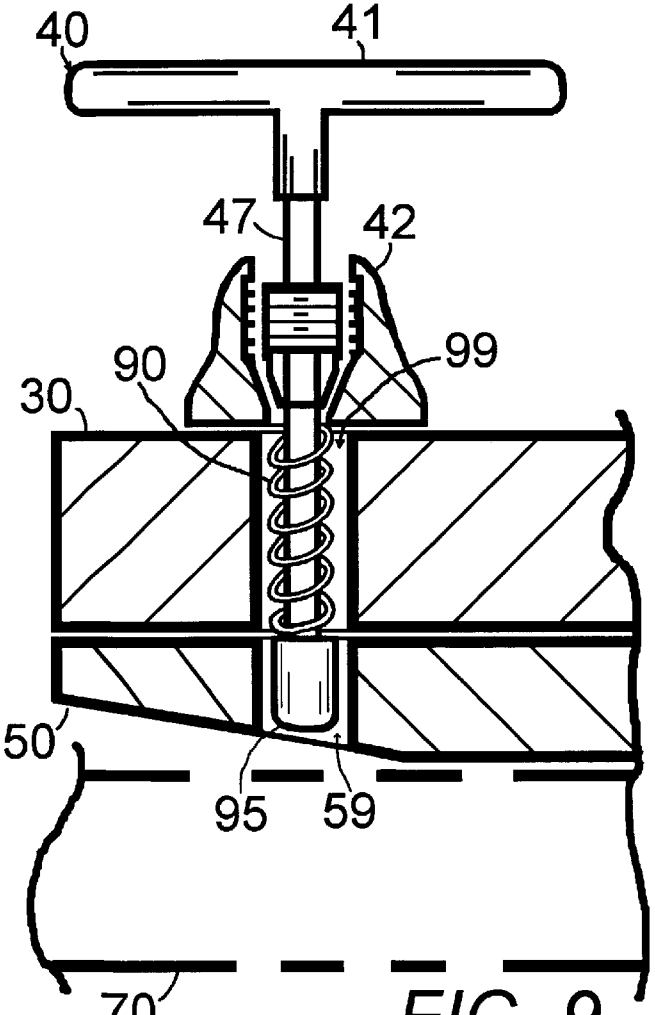
FIG. 9 is an enlarged partial cross-sectional view of an alternate embodiment of the locking mechanism with a spring on the double screw lock in the locked mode position.

In FIGS. 9 and 10, an alternate embodiment of the locking mechanism provides an enlarged lock opening 99 in the rotatable plate 30 with an elastic element, preferably a spring 90 encircling the lock shaft 47 of the double screw lock to bias the lock shaft toward the locked mode shown in FIG. 9 when the lock shaft is unscrewed from the released mode shown in FIG. 10. The spring 90 is held in place between an enlarged tip 95 of the lock shaft 47 and the bottom of the locking base 42.

Figure 12:
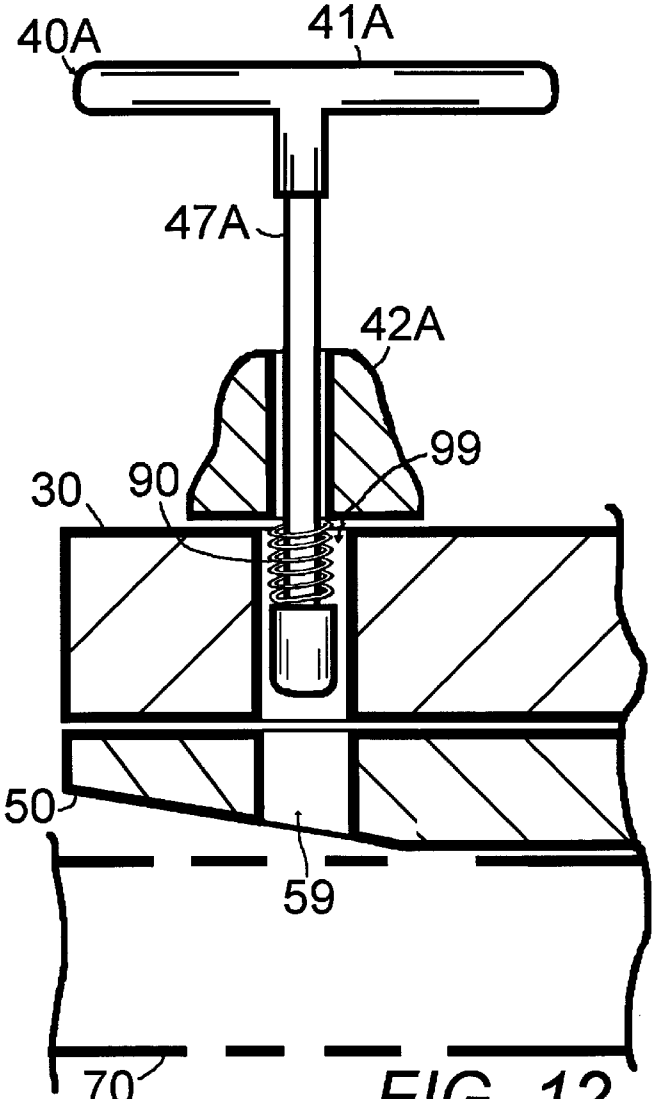
FIG. 12 is an enlarged partial cross-sectional view of the other alternate embodiment of the locking mechanism of FIG. 11 with a spring on a non-threaded spring-loaded lock shaft in the released mode position.
Figure 11:
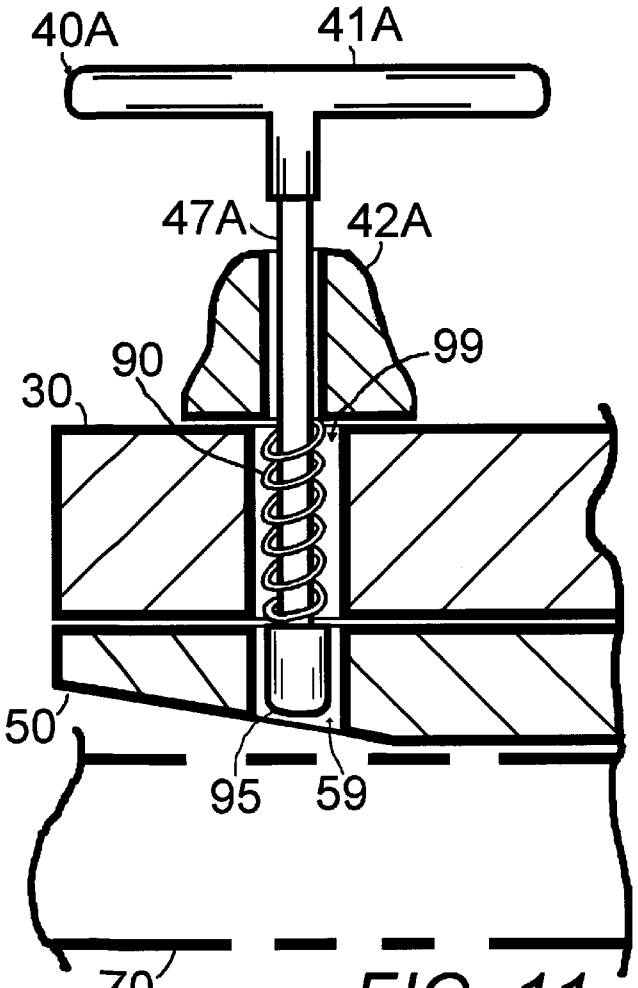
FIG. 11 is an enlarged partial cross-sectional view of another alternate embodiment of the locking mechanism with a spring on a non-threaded spring-loaded lock shaft in the locked mode position.

In FIGS. 11 and 12, another alternate embodiment of the locking mechanism has an enlarged lock opening 99 in the rotatable plate 30 to receive an elastic element, preferably a spring 90 surrounding a non-threaded spring-loaded lock shaft 47A of an alternate locking mechanism 40A with large T-handle 41A. The spring 90 biases the lock shaft 47A in the locked mode position for retaining the snowboard boot binding in the locked stationary position, as shown in FIG. 11. The shaft locks automatically from the force of the spring 90 when the lock shaft 47A is let go from the manually held released mode position, shown in FIG. 12, which released mode position permits rotation of the snowboard boot binding. The spring 90 is held in place between an enlarged tip 95 of the lock shaft 47A and the bottom of the locking base 42A.

Figure 13:
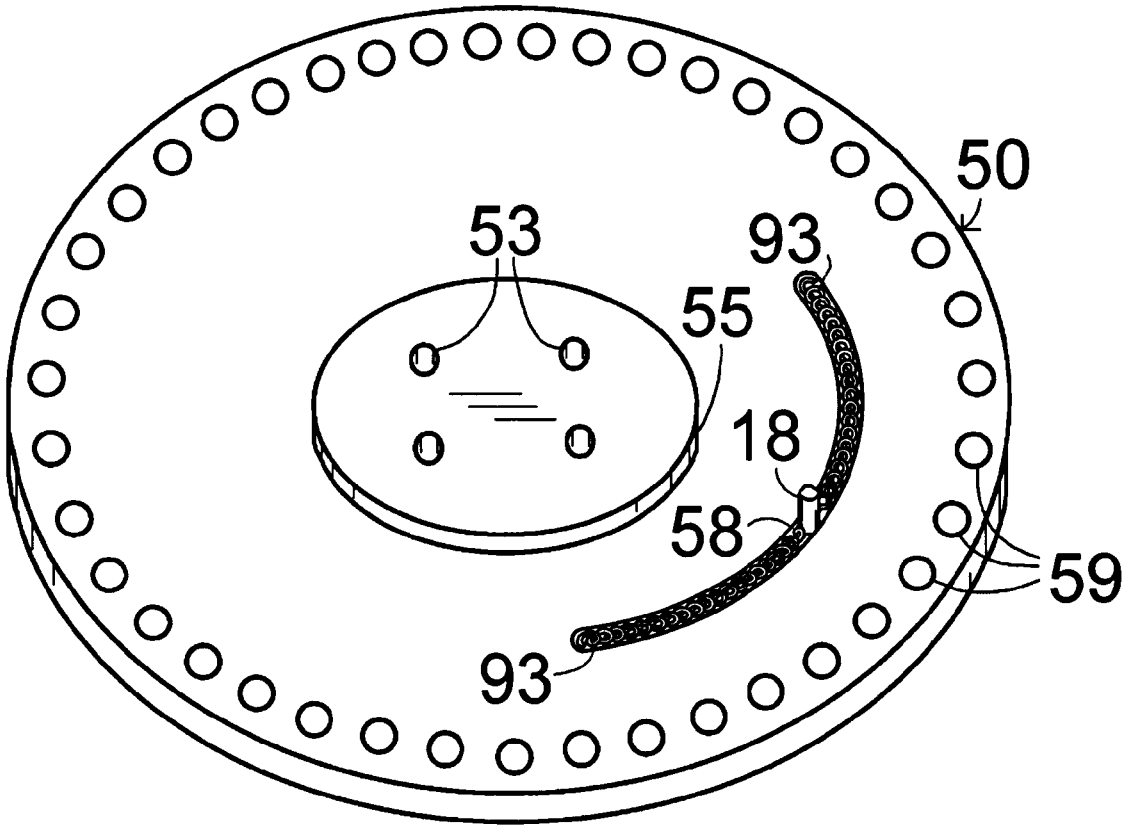
FIG. 13 is an enlarged perspective view of the base plate showing the safety means groove and mating pin from the rotatable plate with a pair of springs inserted in the groove with one on each side of the pin.

In FIG. 13, an alternate embodiment of the rotation safety means comprises a pair of springs 93 inserted in the groove 58, with one spring 93 on each side of the mating pin 18 from the rotatable plate (not shown) to regulate the rotation of the rotatable plate relative to the base plate. The springs 93 are capable of regulating the rate of the rotation of the rotatable plate and biasing the rotatable plate to return to a single angular orientation relative to the base plate, the springs alternately biasing the pin to return to the same central position in the groove as the rotatable plate is rotated and released and maintaining a controlled pressure on the rotatable plate as it is turned. The springs are held in place in the groove by the rotatable plate 30 and the snowbeard 70 which sandwich the lock plate 50 therebetween. While springs are preferred other elastic elements may be used.

An elevated information bearing surface 39 is formed adjacent to the boot binding groove 38 elevated by wall 37 on the side opposite to the lock mechanism 40 on the rotatable plate 30. Information 32 such as an advertising message with a name or phone number of the seller of the invention or the name of the owner of the snowboard may be visibly attached to the information bearing surface 39 by a plate 31 screwed on or a label adhered thereto bearing information affixed thereon or by imprinting or inscribing the information thereon.

In FIGS. 1, 2, and 6–8, a safety means is incorporated in the base plate and the rotatable plate to limit the degree of relative rotation therebetween to permit the snowboard boot to turn within a safe limit and prevent the snowboard boot from turning beyond the safe limit. One of the pair of rigid plates has a groove 58, shown in the base plate 50, therein in the shape of an arc of a circle and the other of the pair of the rigid plates has a mating pin 18, shown in the rotatable plate 30, protruding downwardly therefrom, the pin 18 engaging the groove 58 and thereby limiting the degree of relative rotation of the rigid plates to the degree of the arc of the circular groove 58, which is preferably 100 degrees. The groove is preferably cut through the plate and the pin may be formed with the other plate or welded or bolted on or otherwise attached. This safety feature prevent over-extension of the knee and ankle which might occur if the boot rotated too far. This permits a safe limit of free rotation of the boot while going downhill or performing any other activity.

The plates and cap of the invention are preferably fabricated of a non-rust durable material, such as a non-rusting metal plate or structurally durable molded or injected plastic. The lock shaft is preferably fabricated of stainless steel or other non-rusting strong metal. The low-friction ring is preferably fabricated of a low-friction material such as Nylon®.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A snowboard boot binding attachment device for securing a snowboard boot binding to a snowboard and for permitting angular adjustment of the snowboard boot binding relative to the snowboard, comprising:

a pair of rigid plates including a circular base plate adapted to be secured to the snowboard and a rotatable plate for receiving the snowboard boot binding to be secured thereto, the rotatable plate being positioned above the base plate and being rotatably connected to the base plate; and a locking assembly for locking the rotatable plate in selected positions of angular adjustment relative to the base plate and for selectively maintaining the rotatable plate in either a locked mode, in which the rotatable plate is prevented from rotating relative to the base plate or a released mode, in which the rotatable plate is free to rotate relative to the base plate, the locking assembly including a locking ring formed by a plurality of locking holes extending through a circumferential portion of the base plate, an opening extending through the rotatable plate and alignable with the locking holes in the selected positions of angular adjustment, and a locking shaft capable of alternating between a locked position extending through the opening of the rotatable plate into one of the plurality of locking holes in the base plate to retain the rotatable plate in the locked mode wherein rotation of the rotatable plate is prevented, and an unlocked position with the locking shaft retracted from the one of the plurality of locking holes in the base plate to put the rotatable plate in the released mode, thereby permitting angular adjustment of the snowboard boot binding relative to the snowboard, the locking assembly further including a locking base attached to the rotatable plate, a sleeve threadedly received within the locking base, and locking members depending from the sleeve, the sleeve being slidably fitted over the locking shaft and being nonrotatable relative to the locking shaft, the sleeve being rotatable relative to the locking base upon rotation of the locking shaft, and the locking members preventing sliding movement of the locking shaft relative to the sleeve upon selective rotation of the locking shaft for maintaining the locking shaft in the unlocked position and the rotatable plate in the released mode, thereby permitting free rotational movement of the rotatable plate relative to the base plate;

a safety means incorporated in the base plate and the rotatable plate, the safety means capable of limiting the degree of relative rotation therebetween to permit the snowboard boot to turn within a safe limit and prevent the snowboard boot from turning beyond the safe limit, the safety means comprising one of the pair of rigid plates having a groove therein in the shape of an arc of a circle and the other of the pair of the rigid plates having a mating pin protruding therefrom, the pin engaging the groove and thereby limiting the degree of relative rotation of the rigid plates to the degree of the arc of the circular groove.

2. The device of claim 1 further comprising at least one elastic element interconnecting the rotatable plate and the base plate to regulate the rotation of the rotatable plate relative to the base plate.

3. The device of claim 2 wherein the at least one elastic element comprises at least one spring inserted in the groove in contact with the pin, the at least one spring capable of regulating the rate of the rotation of the rotatable plate and biasing the rotatable plate to return to a single angular orientation relative to the base plate.

4. The device of claim 3 wherein a pair of springs are inserted in the groove with one spring on each side of the pin.

5. The device of claim 1 wherein the locking shaft comprises a rigid shaft and a shaft elastic element between the rigid shaft and the rotatable plate biasing the rigid shaft in the locked position.

6. The device of claim 5 wherein the shaft elastic element comprises a spring.

7. The device of claim 1 wherein the locking shaft further comprises an elastic element communicating between the locking shaft and the rotatable plate biasing the locking shaft into the locked position upon release from the unlocked position.

8. The device of claim 1 wherein the arc of the circular groove is 100 degrees.

9. The device of claim 1 wherein the locking shaft is provided at its top end with a T-shaped handle protruding above the rotatable plate.

10. The device of claim 1 wherein the locking ring having the locking holes therein is elevated above the snowboard so that fluids may drain from the locking holes and icing of the locking holes is prevented.

11. The device of claim 1 further comprising a roller bearing between the rotatable plate and the base plate to facilitate rotation therebetween.

12. The device of claim 1 further comprising a cap plate for securing the boot binding and the rotatable plate to the base plate so that the boot binding and rotatable plate are rotatable relative to the base plate and the cap plate.

13. The device of claim 12 wherein the rotatable plate and the boot binding further comprise mating circular openings therethrough and the cap plate further comprises an elevated peripheral rim and a downwardly protruding circular bottom smaller in diameter than the mating circular openings so that the downwardly protruding circular bottom of the cap plate is capable of fitting in the mating circular openings and contacting the base plate to which the cap plate is secured, while the elevated peripheral rim of the cap plate is sufficiently elevated above the boot binding so that the rotatable plate and the boot binding are rotatable relative to the base plate and the cap plate, with the rotatable plate and the boot binding sandwiched therebetween.

14. The device of claim 13 wherein the boot binding further comprises a ring of upwardly protruding teeth around an edge of the circular opening and further comprising a low-friction ring having a bottom ring of downwardly protruding teeth which are capable of meshing with the ring of upwardly protruding teeth of the boot binding and the low-friction ring having a top low-friction surface, the low-friction ring capable of being inserted between the cap plate and the boot binding so that the top low-friction surface of the low-friction ring slidably engages the elevated peripheral rim of the cap plate.

15. The device of claim 14 further comprising a roller bearing between the cap plate and the low-friction ring to facilitate rotation therebetween.

16. The device of claim 15 further comprising a roller bearing between the rotatable plate and the base plate to facilitate rotation therebetween.

17. The device of claim 1 wherein the base plate further comprises an elevated circular guide post protruding from the top center of the base plate and the rotatable plate is provided with a circular opening therein larger in diameter than the guide post and the elevated guide post is capable of receiving the circular opening of the rotatable plate to guide the mounting of the rotatable plate onto the base plate in a desired orientation.

18. The device of claim 1 wherein the rotatable plate further comprises a wide groove in the top surface of the rotatable plate to accommodate the snowboard boot binding therein.

19. The device of claim 1 wherein the rotatable plate further comprises an elevated information surface capable of displaying information thereon visible on the top of the rotatable plate.

* * * * *